US005590717A

United States Patent [19]

McBay et al.

[11] Patent Number: 5,590,717

[45] Date of Patent: Jan. 7, 1997

[54] FIRE EXTINGUISHING CAPSULE

[76] Inventors: Henry R. C. McBay, deceased, late of Atlanta, Ga.; by Ronald P. W. McBay, administrator, 2889 Seven Pines La., Atlanta, Ga. 30339-5801

[21] Appl. No.: 570,080

[22] Filed: Dec. 11, 1995

[51] Int. Cl.[6] ..... A62C 13/62

[52] U.S. Cl. ..... 169/52; 169/26; 169/54; 169/69; 220/4.25

[58] Field of Search ..... 169/52, 53, 26, 169/54, 69, 36; 220/4.25, 901

[56] References Cited

U.S. PATENT DOCUMENTS

| | | | |
|---|---|---|---|
| 1,149,975 | 8/1915 | Cole . | |
| 1,453,091 | 4/1923 | Delbare . | |
| 2,328,491 | 8/1943 | Puchner . | |
| 2,349,980 | 5/1944 | Moore . | |
| 2,845,199 | 7/1958 | Putman et al. | 220/901 |
| 3,043,466 | 7/1962 | Gardner | 220/901 |
| 3,132,695 | 5/1964 | Peltier | 169/26 |
| 3,980,139 | 9/1976 | Kirk . | |
| 4,285,403 | 9/1981 | Poland . | |
| 4,319,640 | 3/1982 | Brobeil . | |
| 4,328,867 | 5/1982 | Heath . | |
| 4,637,472 | 1/1987 | Decima . | |
| 4,760,886 | 9/1988 | Sassier . | |
| 5,232,053 | 8/1993 | Gillis . | |
| 5,327,732 | 7/1994 | DeAlmeida . | |

FOREIGN PATENT DOCUMENTS

| | | | |
|---|---|---|---|
| 1058561 | 12/1983 | U.S.S.R. | 169/36 |
| 545368 | 5/1942 | United Kingdom | 169/26 |
| 1061075 | 3/1967 | United Kingdom | 169/53 |

*Primary Examiner*—Gary C. Hoge
*Attorney, Agent, or Firm*—Paul H. Ware

[57] ABSTRACT

The object of the invention is to provide an apparatus for the cooling and quenching of destructive fires. The Fire Extinguishing Capsule comprises two double-walled hemishapes which are sealed together by an equatorial belt seal which may be raptured in order to disperse the extinguishant in the capsule. The capsule may be suspended in sire or from a hook and ladder system or a helicopter in the case of forest fires or oil well fires or transported by sled to a fire scene.

14 Claims, 2 Drawing Sheets

10
12
18
36
40
38
14
16
14
16
42
20
26
2
44
3
3
46
46
2
28
34
22
48
48
30
32
58

FIRE EXTINGUISHING CAPSULE

TECHNICAL FIELD

This invention relates to apparatus which includes as a purpose the rapid cooling and quenching of destructive fires. The purposes of the invention are accomplished in general through the deployment of a cooling and fire extinguishing material which serves both to cool down the surrounding area and also to extinguish any and all fires or flames in that area covered by the expanding cooling extinguishant.

BACKGROUND INFORMATION

In prior an cryogenic fire extinguishing devices, difficulties of maintaining cryogenic extinguishant materials in storage are encountered because, among other things, of the steep temperature gradient between storage facilities and the inner wall of the cryogenic material container.

In some pre-pressurized bottle systems problems are encountered with respect to the solubility of a pressurizing agent into the extinguishant material resulting in an overall loss of pressurization and thus, an inefficient scattering of the fire retardant material.

In systems requiring the detonation of an explosive charge for actuation, it is necessary that the charge and its detonating mechanism be periodically inspected and, if aging is a debilitating factor, be renewed or replaced. In some prior art systems, it is necessary that the detonation device be manually armed prior to deployment.

In almost all utilizations of fire extinguishing devices it is important that the apparatus and method used to put a fire out not be more expensive than the protected premises nor be too complicated for facile deployment.

The instant invention intends the overcoming of difficulties encountered in the prior art as delineated above.

The prior art includes U.S. Pat. No. 1,149,975, to A. L. Cole for *Fire Extinguishing Bomb*, issued Aug. 10, 1915. The device described in the Cole patent provides an in situ device adapted to be placed in a room in which a fire may occur. The device is intended to replace or be used instead of a sprinkler system or the like and contemplates a frangible glass bottle to contain the fire retardant material employed for the purpose of extinguishing the fire.

Another prior art device is described in the U.S. Pat. No. 1,453,091 granted to H. E. Delbare for *Means for Extinguishing Fire*, issued Apr. 24, 1923. Delbare contemplates another in situ device to be activated upon extreme temperature elevation thereby causing a deposition of solder to melt so as to release a springed striking device thus activating a detonator and causing atomization of a liquid fire extinguishant. Again a glass receptacle is employed to contain the extinguishing material. The glass receptacle is intended to be burst into pieces by the explosion started by the detonator thereby deploying the fire extinguishing material.

Yet another prior art device has been illustrated in the U.S. Pat. No. 4,285,403, granted to Poland and issued Aug. 25, 1981, for *Explosive Fire Extinguisher*. In the Poland invention, an explosive charge is located substantially in the center of a frangible, spherical shell containing an aqueous solution. The combination of droplets formed in the explosion of the device, fire retardant chemicals contained in the droplets, displacement of oxygen supporting the fire and the concussive force of the explosion acts to extinguish the fire.

U.S. Pat. No. 4,637,472, granted to Decima for *Rapid Discharge Extinguisher* issued Jan., 20, 1987, describes another prior art device intended for use in situ in an area used for storing explosives and activated by a detonator subsequent to detection of a fire.

Patentee Sassier's U.S. Pat. No. 4,760,886, for *Fast Discharge Fire Extinguisher and a Method of Fabricating Same*, granted Aug. 2, 1988, is essentially the same as the Decima device as indicated by Sassier at column 1 in his Description of the Prior Art, but claiming lower cost.

U.S. Pat. No. 5,327,732 issued to DeAlmeida on Jul. 12, 1994 for *Apparatus for Supplying Cryogenic Fluid, Namely Nitrogen, to Extinguish Fires* describes a highly complicated and sophisticated apparatus including a microprocessor used in controlling nitrogen flow and vaporization. The device appears to be intended to be transported to the fire scene on a wheeled carriage.

An additional prior art U.S. Pat. No. 2,328,491, for *Bomb Comprising a Compressed Mass of Fire Extinguishing Powder*, to E. Puchner issued Aug. 31, 1943, uses a molded mass of fire retardant powder to be exploded so as to disperse the material and thus to end the fire. The molded mass of extinguishant is not encased in any container, rather it is held together by a binding agent.

The U.S. Pat. No. 2,349,980, issued May 30, 1944 to L. W. Moore for *Forest Fire Extinguisher* contemplates an extinguishing powder deployed upon detonation of an explosive charge through contact of a nose trigger on the bomb-like device.

In U.S. Pat. No. 3,980,139, issued Sep. 14, 1976 to N. Kirk for *Fire Extinguishing Bomb for Putting Out Fires* the fire retardant is scattered by an explosive charge and is to be installed in a building or the like or is to be dropped on a fire.

Still another prior art patent tamed up in applicant's pre-examination search bears U.S. Pat. No. 4,319,640 and the title *Gas Generator-Actuated Fire Suppressant Mechanism*. It was issued to Karl R. Brobeil on Mar. 16, 1982. The innovative device contemplates suppression of fires in military vehicles. Fire retardant liquid is expelled via a duct so as to be directed and is actuated by means of a detonating system.

The penultimate prior art patent presented herewith is U.S. Pat. No. 5,232,053 for *Explosion Suppression System* issued to Gillis et al on Aug. 3, 1993. The device described therein contemplates an explosive actuated mechanism wherein an explosion suppressant is directed by means of a duct. An explosion protection system is described and claimed rather than a fire extinguishing system, however, in the interest of thorough disclosure of prior art patents discovered in applicant's search, this less relevant patent is included.

The final prior art patent discovered in applicant's pre-examination novelty search and cited herewith is U.S. Pat. No. 4,328,867 and was granted to Richard C. Heath on May 11, 1982, for *Fire Extinguishers*. The patent describes a system having a diaphragm, burstable by means of a detonated explosion that is controlled by an electric circuit.

These prior art devices are commendable and show a creative spirit for their times. The inventors and their inventions have contributed remarkably to the technology involved. However, these prior art structures do not include those combined elements of the instant invention that provide greater facility of use and ingenious arrangement of components and that make the instant invention the high culmination in the art.

DISCLOSURE OF INVENTION

In accordance with the instant invention, there is provided an apparatus by memos of which a blanket of fire extinguishant may be spread over and into a fire-involved area serving both to cool and to squelch the conflagration.

Hemisectional, double-walled vessels are joined together equatorially by means of a sealing belt or the like to form a container or capsule for containing a cooling fire extinguishant material. The double walls provide an inner shell and an outer shell such that a space thus established between them may be evacuated so as to provide an insulating vacuum therebetween. Thus, a possibly steep temperature gradient between a storage facility's ambient temperature and the inner wall of the capsule will not affect the cooling fire extinguishant material contained therein. This facility becomes increasingly important when the cooling fire extinguishing material used is of a cryogenic nature. The capsule's double wall additionally may provide an added measure of integrity for the capsule in the event the outer wall becomes compromised or ruptured when the capsule is dropped into a fire. Any cooling fire extinguishant material would still be contained within the inner shell until deployment for putting the fire out. The equatorial belt is designed such that increased pressure from within the container will rupture the belt so as to release the extinguishant over selected arcs up to and including the entire 360° range. When filled, for example, with liquid nitrogen at about −195° C. or perhaps carbon dioxide at a temperature of about −80° C., the device, when made incident in the fire, will be ruptured by means of and in response to the rising temperature of the surrounding fire whether it be a forest fire, a fire at an industrial plant, a fire in a private dwelling or an oil well fire or the like. Alternatively, the device may be ruptured from afar by means of an extremely hot projectile, for example, one fired from a high-powered rifle through the thin, belted window so as to produce a sudden increase in internal temperature. As an additional alternative, the device may be equipped with an energy cell mounted interiorly of the container and to be actuated into explosion by remote control. The prior art is replete with means and methods of rupturing vessels containing fire retardant materials. Many of these means and methods are in the public domain and may be utilized in the present invention with impunity.

BRIEF DESCRIPTION OF THE DRAWINGS

Further advantages and features of the instant invention will be more fully apparent to those skilled in the art to which the invention pertains from the ensuing detailed description thereof, regarded in conjunction with the accompanying drawings wherein like reference numerals refer to like parts throughout and in which.

BEST MODE FOR CARRYING OUT THE INVENTION

Figure 1:
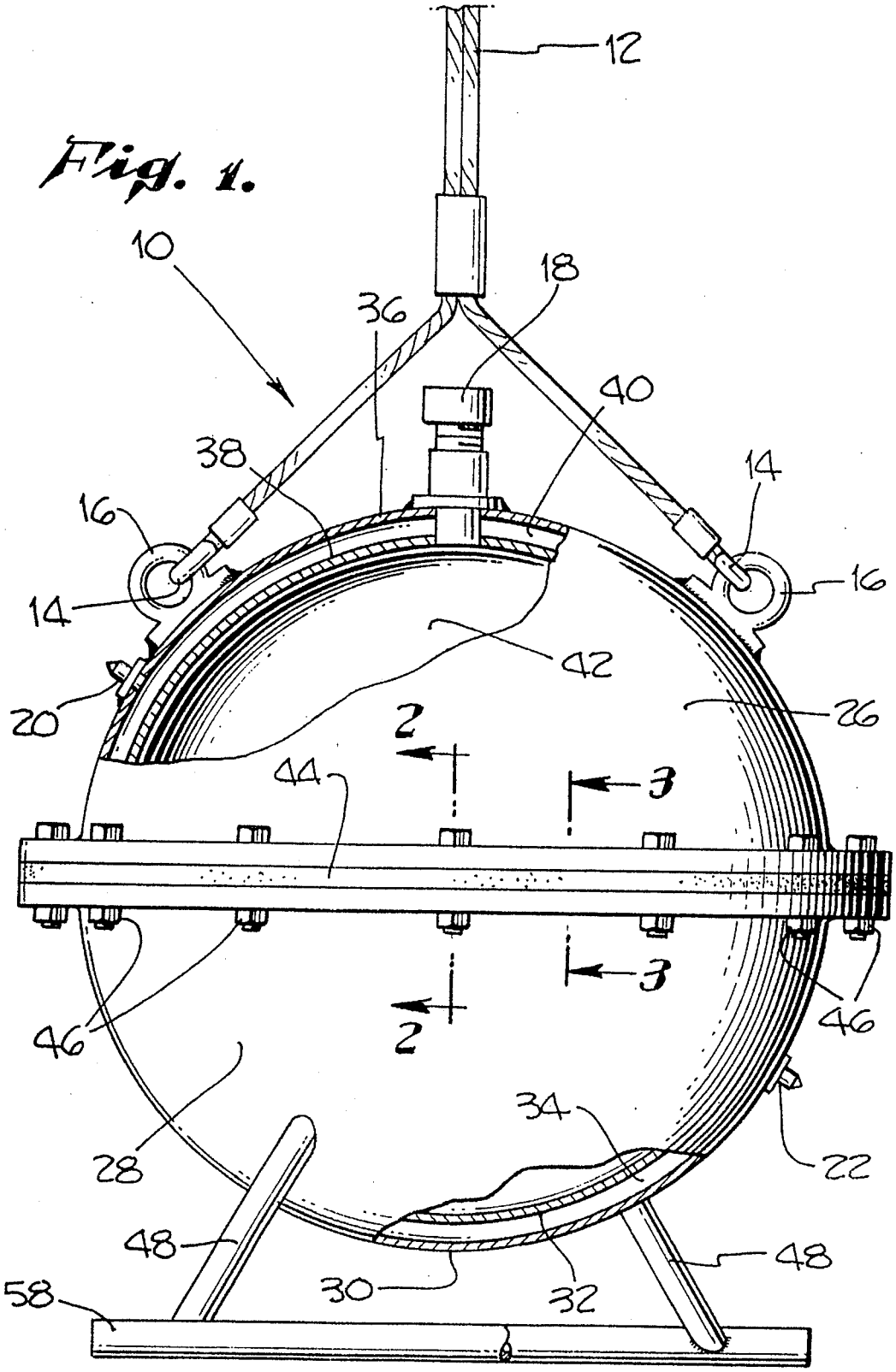
FIG. 1 is a side elevational view of the invention partly cut away to show detail.
Figure 2:
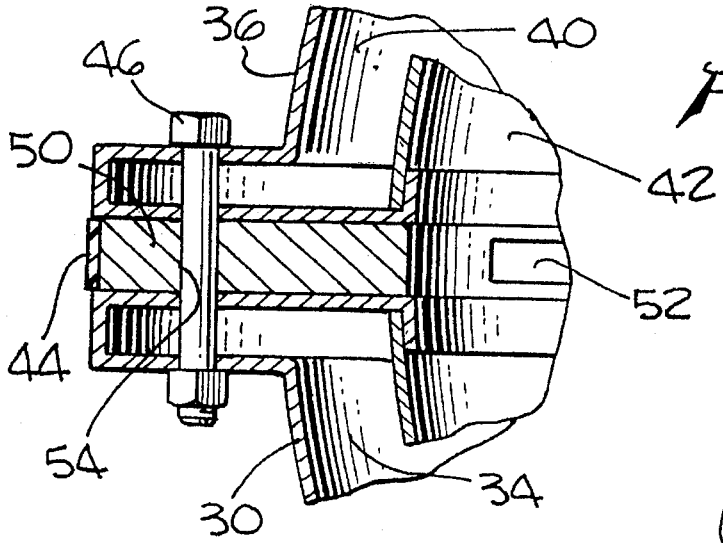
FIG. 2 is a fragmentary, enlarged, cross-sectional view taken along the sight lines 2—2 of FIG. 1.
Figure 3:
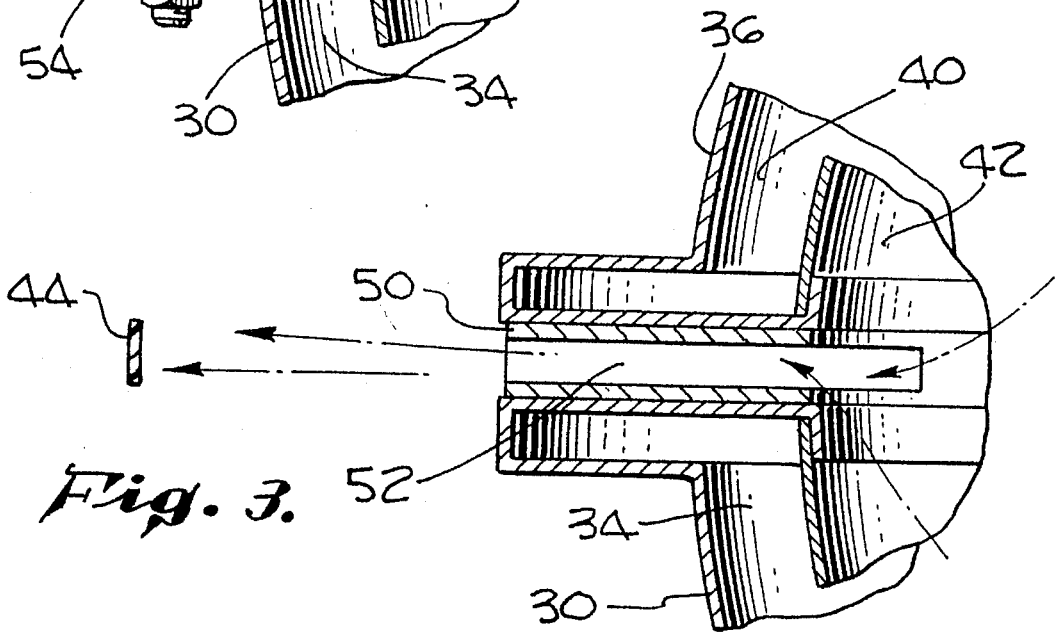
FIG. 3 is a fragmentary, enlarged, cross-sectional view taken along the sight lines 3—3 of FIG. 1.
Figure 4:
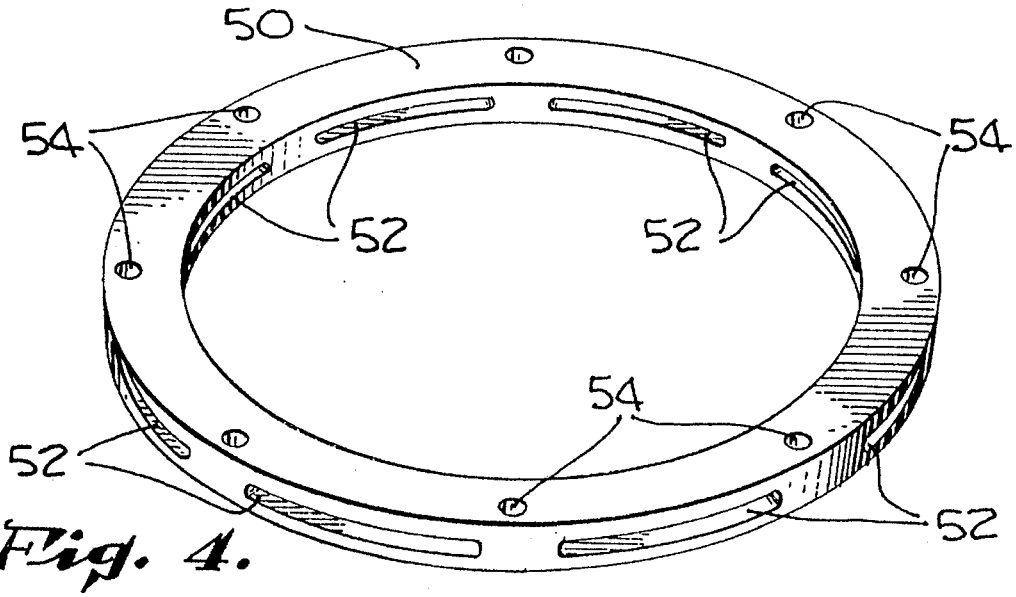
FIG. 4 is a perspective view showing detail of an element of the invention.

Referring to the drawing and to FIGS. 1 through 4 with greater particularity, the Fire Extinguishing Capsule is denoted generally by the numeral 10 and comprises an upper vessel 26 and a lower vessel 28, shown in the drawing as hemispheres. However, the upper and lower vessels may be of any shapes whatsoever and have been shown as hemispheres merely for ease of illustration and explication. These upper and lower vessels shall be referred to hereinafter as hemishapes. The capsule may be deployed, among other means, by means of being suspended in situ via suspension cable 12 or may be transported by helicopter as so suspended to a desired location or alternatively may be conveyed by means of a sled having sled runners 58 with sled struts 48. As shown in FIG. 1, cable 12 may be attached to the capsule 10 by means of hook 14 and ring 16.

Upper hemishape 26 is adapted to be attached to lower hemishape 28 by means of assembly bolts 46 and sealed thereto by means of equatorial belt seal 44. Upper and lower hemishapes 26 and 28 respectively comprise upper and lower hemishape outer shells, 36 and 30 respectively and upper and lower hemishape inner shells 38 and 32 also respectively. Between the inner and outer shells of both hemishapes, there is provided a space that may be evacuated. The space so provided for upper hemishape 26 is denoted by the numeral 40 and for the lower hemishape 28 by the numeral 34. Upper hemishape 26 has an evacuation valve 20 allowing evacuation of space 40 thus to create a vacuum therein, while lower hemishape 28 has an evacuation valve 22 provided for the same purpose to create a vacuum in space 34.

Window ring 50, having window slots 52, is adapted to be assembled between upper and lower hemishapes 26 and 28 by means of assembly bolts 46 through bolt holes 54 and sealed by means of seal 44 so as to effect the general assembly and sealing of the capsule 10. After sealing, a cooling fire extinguishant may be introduced into the cooling extinguishant chamber 42 of the sealed capsule and retained therein by means of a conventional filler cap inlet 18 having a safety pressure valve such as is routinely built into any device which is designed to hold liquefied gases. These conventional devices allow for the outlet of vaporized gas from, for example, liquid nitrogen as it boils at room temperature. However, at much higher temperatures or under sudden increases in pressure beyond the range of capability of this pressure regulating device, the capsule would suffer a rupture of its belt seal and the extinguishant would thus escape. Window slots 52 may be left open or selectively obstructed so as to control the directions of effluence of the extinguishant upon activation of the capsule for purposes of extinguishing a fire. Thus the window slots 52 may be designed so as to direct the expulsion of the extinguishant over selected arcs.

Sealing belt 44 is designed to be thin such that increased pressure from within the vessel will activate the device by rupturing the belt seal so as to release the extinguishant. Other means may be employed for activation, for example, activation may be accomplished by firing an extremely hot projectile through the thin belted seal so as to produce a sudden increase in internal temperature and thus a rupture of the seal. More sophisticated devices for activation are known in the prior art as set forth hereinbefore, however, these activation devices form no part of the present invention..

INDUSTRIAL APPLICABILITY

The present invention finds application wherever destructive fires are required to be quenched. Examples include forest fires, fires in industrial plants, fires in private dwellings oil well fires and many others.

ABSTRACT OF THE DRAWINGS

In the drawings, the numbers refer to like parts and for the purpose of explication, set forth below are the numbered parts of the Fire Extinguishing Capsule of this invention.

| ID | Description of Element | In Fig. |
|---|---|---|
| 10 | Fire Extinguishing Capsule in general | 1 |
| 12 | suspension cable | 1 |
| 14 | hook | 1 |
| 16 | ring | 1 |
| 18 | filler cap inlet | 1 |
| 20 | upper hemishape evacuation valve | 1 |
| 22 | lower hemishape evacuation valve | 1 |
| 26 | upper hemishape | 1 |
| 28 | lower hemishape | 1 |
| 30 | lower hemishape outer shell | 1, 2 |
| 32 | lower hemishape inner shell | 1 |
| 34 | vacuum space for lower hemishape | 1, 3 |
| 36 | upper hemishape outer shell | 1, 3 |
| 38 | upper hemishape inner shell | 1 |
| 40 | vacuum space for upper hemishape | 1, 3 |
| 42 | cooling extinguishant chamber | 1, 2 |
| 44 | equatorial belt seal | 1, 2, 3 |
| 46 | assembly bolts | 1, 2 |
| 48 | sled strut | 1 |
| 50 | window ring | 2, 4 |
| 52 | window slots | 3, 4 |
| 54 | bolt holes | 4 |
| 58 | sled runner | 1 |

I claim:

1. A fire extinguishing capsule for cooling and extinguishing destructive fires, comprising:

a double-walled upper hemishape having an upper hemishape outer shell and an upper hemishape inner shell;

a vacuum space between said upper hemishape outer shell and said upper hemishape inner shell;

a double walled lower hemishape having a lower hemishape outer shell and a lower hemishape inner shell;

a vacuum space between said lower hemishape outer shell and said lower hemishape inner shell;

a window ring adapted to be interposed and sealed between said double walled upper hemishape and said double walled lower hemishape;

means for securing and sealing said double walled upper hemishape to said double walled lower hemishape;

a cooling extinguishant chamber formed between said double walled hemishapes by the securing and sealing together of said hemishapes;

means for filling said chamber with cooling fire extinguishant material.

2. The device of claim 1 wherein said window ting includes window slots to direct the flow of said cooling fire extinguishant material.

3. The device of claim 2 wherein said means for securing and sealing includes a thin belt seal adapted to rupture upon a substantial pressure increase in said fire extinguishant material in said cooling extinguishant chamber.

4. The device of claim 2 wherein said window slots may be selectively obstructed so as to control the effluence of said cooling fire extinguishant material.

5. A fire extinguishing capsule for cooling and extinguishing destructive fires, comprising:

a double-walled upper hemishape having an upper hemishape outer shell and upper hemishape inner shell;

a vacuum space between said upper hemishape outer shell and said upper hemishape inner shell;

a double walled lower hemishape having a lower hemishape outer shell and a lower hemishape inner shell;

a vacuum space between said lower hemishape outer shell and said lower hemishape inner shell;

means for securing and sealing said double walled upper hemishape to said double walled lower hemishape;

a cooling extinguishant chamber formed between said double walled hemishapes by the securing and sealing together of said hemishapes;

means for filling said chamber with cooling fire extinguishant material; and a window ring adapted to be interposed and sealed between said double walled upper hemishape and said double walled lower hemishape.

6. A fire extinguishing capsule for cooling and extinguishing destructive fires, comprising:

a double-walled upper hemishape having an upper hemishape outer shell and an upper hemishape inner shell;

a vacuum space between said upper hemishape outer shell and said upper hemishape inner shell;

a double walled lower hemishape having a lower hemishape outer shell and a lower hemishape inner shell;

a vacuum space between said lower hemishape outer shell and said lower hemishape inner shell;

means for securing and sealing said double walled upper hemishape to said double walled lower hemishape;

a cooling extinguishant chamber formed between said double walled hemishapes by the securing and sealing together of said hemishapes;

means for filling said chamber with cooling fire extinguishant material;

a window ting adapted to be interposed and sealed between said double walled upper hemishape and said double walled lower hemishape; and wherein said window ring includes window slots to direct the flow of said cooling fire extinguishant material.

7. A fire extinguishing capsule for cooling and extinguishing destructive fires, comprising:

a double-walled upper hemishape having an upper hemishape outer shell and an upper hemishape inner shell;

a vacuum space between said upper hemishape outer shell and said upper hemishape inner shell;

a double walled lower hemishape having a lower hemishape outer shell and a lower hemishape inner shell;

a vacuum space between said lower hemishape outer shell and said lower hemishape inner shell;

means for securing and sealing said double walled upper hemishape to said double walled lower hemishape;

a cooling extinguishant chamber formed between said double walled hemishapes by the securing and sealing together of said hemishapes;

means for filling said chamber with cooling fire extinguishant material;

a window ring adapted to be interposed and sealed between said double walled upper hemishape and said double walled lower hemishape;

wherein said window ring includes window slots to direct the flow of said cooling fire extinguishant material; and wherein said means for securing and sealing includes a thin belt seal adapted to rupture upon a substantial pressure increase in said fire extinguishant material in said cooling extinguishant chamber.

8. A fire extinguishing capsule for cooling and extinguishing destructive fires, comprising:

a double-walled upper hemishape having an upper hemishape outer shell and an upper hemishape inner shell;

a vacuum space between said upper hemishape outer shell and said upper hemishape inner shell;

a double walled lower hemishape having a lower hemishape outer shell and a lower hemishape inner shell;

a vacuum space between said lower hemishape outer shell and said lower hemishape inner shell;

means for securing and sealing said double walled upper hemishape to said double walled lower hemishape;

a cooling extinguishant chamber formed between said double walled hemishapes by the securing and sealing together of said hemishapes;

means for filling said chamber with cooling fire extinguishant material;

a window ring adapted to be interposed and sealed between said double walled upper hemishape and said double walled lower hemishape;

wherein said window ring includes window slots to direct the flow of said cooling fire extinguishant material; and wherein said window slots may be selectively obstructed so as to control the effluence of said cooling fire extinguishant material.

9. A fire extinguishing capsule for cooling and extinguishing destructive fires, comprising:

two hemishape shells;

a window ring adapted to be interposed and sealed between said hemishape shells;

means for securing and sealing said hemishape shells;

an extinguishant chamber formed between said hemishapes shells by the securing and sealing together of said hemishape shells;

means for filling said chamber with fire extinguishant material.

10. The fire extinguishing capsule according to claim 9 wherein said window ting includes window slots to direct the flow of said fire extinguishant material.

11. The fire extinguishing capsule according to claim 10 wherein said means for securing and sealing includes a thin belt seal adapted to rupture upon a substantial pressure increase in said fire extinguishant material in said extinguishant chamber.

12. The fire extinguishing capsule according to claim 10 wherein said window slots may be selectively obstructed so as to control the effluence of said fire extinguishant material.

13. A method for cooling and extinguishing destructive fires comprising the steps of:

providing two hemishape shells;

sealing said shells to form a fire extinguishing capsule having a chamber therein;

filling said chamber with a fire extinguishing material;

delivering said capsule to the situs of the fire;

releasing said extinguishing material thereby cooling and extinguishing the fire in the vicinity of the capsule;

providing a window ring having a plurality of window slots; and releasing said fire extinguishing material through said window slots.

14. A method for cooling and extinguishing destructive fires comprising the steps of:

providing two hemishape shells;

sealing said shells to form a fire extinguishing capsule having a chamber therein;

filling said chamber with a fire extinguishing material;

delivering said capsule to the situs of the fire;

releasing said extinguishing material thereby cooling and extinguishing the fire in the vicinity of the capsule;

wherein the hemishape shells each have an inner and outer walls having a space therebetween; and evacuating said space creating a vacuum therein.

* * * * *